US006749450B1

(12) United States Patent
Chen

(10) Patent No.: US 6,749,450 B1
(45) Date of Patent: Jun. 15, 2004

(54) SOCKET FOR A MEMORY CARD

(75) Inventor: Wan-Tien Chen, Taipei (TW)

(73) Assignee: Egbon Electronics Ltd., Taipei (TW)

( * ) Notice: Subject to any disclaimer, the term of this patent is extended or adjusted under 35 U.S.C. 154(b) by 0 days.

(21) Appl. No.: 10/673,341

(22) Filed: Sep. 30, 2003

(30) Foreign Application Priority Data

Apr. 3, 2003 (TW) ..... 92107665 A

(51) Int. Cl.[7] ..... H01R 29/00
(52) U.S. Cl. ..... 439/188; 439/630
(58) Field of Search ..... 439/188, 630

(56) References Cited

U.S. PATENT DOCUMENTS 6,354,881 B1 * 3/2002 Bricaud et al. ..... 439/630
6,399,906 B1 * 6/2002 Sato et al. ..... 200/61.59
6,435,887 B2 * 8/2002 Koitsalu ..... 439/188
6,485,319 B2 * 11/2002 Bricaud et al. ..... 439/188
6,488,528 B2 * 12/2002 Nishioka ..... 439/489
6,638,087 B1 * 10/2003 Takada et al. ..... 439/188
6,652,300 B2 * 11/2003 Nishioka ..... 439/159
6,688,899 B2 * 2/2004 Rumpel ..... 439/188
6,692,276 B1 * 2/2004 Abe et al. ..... 439/188
6,692,277 B2 * 2/2004 Hu et al. ..... 439/188

* cited by examiner

*Primary Examiner*—Gary Paumen
(74) *Attorney, Agent, or Firm*—Rosenberg, Klein & Lee

(57) ABSTRACT

A socket has a housing for memory card such as MS card (Memory Stick Card), SD card (Secure Digital Memory Card) and MMC card (Multi Media Card), SM card (Smart Media Card). The housing is integrally formed to have a SD contact, a SD card detect contact, a SD write protect contact, a SM contact, a SM card detect contact and a SM write protect contact. Furthermore, arrangement of the different contacts enables the operator to withdraw the memory cards which are securely inserted into the socket easily to ensure the completeness and accuracy of read/write action.

7 Claims, 15 Drawing Sheets

SOCKET FOR A MEMORY CARD

BACKGROUND OF THE INVENTION

1. Field of the Invention

The present invention relates to a socket, and more particularly to a socket for a memory card such as MS card (Memory Stick Card), SD card (Secure Digital Memory Card) and MMC card (Multi Media Card), SM card (Smart Media Card). The socket is integrally formed so as to enhance the capability to use available space and to accord with lightweight, slim, short and compact requirements. Furthermore, the arrangement of different terminals enables the operator to withdraw the memory cards which are securely inserted into the socket easily to ensure the completeness and accuracy of read/write action.

2. Description of Related Art

With reference to FIGS. 24, 25 and 26, it is noted that a conventional socket (50) includes a base (51) and a top cover (52), which requires two different molds to manufacture the base (51) and the top cover (52) respectively such that manufacture cost is high.

Furthermore, when the SMC (Smart Media Card) legs (54,55) are received in the base (51), the operator will have to change the usual habit to adapt to the configuration of the conventional socket (50). Again, when the MS (Memory Stick) card (40) is implemented to the socket (50), usually, the operator will deem that the side with the connection plates is the bottom side such that when the contacts (56) are received in the base (51), the withdraw direction of the MS card (40) is not so adapted to meet with the conventional withdrawn direction of the SM card (40).

To overcome the shortcomings, the present invention tends to provide an improved socket to mitigate the aforementioned problems.

SUMMARY OF THE INVENTION

The primary objective of the present invention is to provide an improved socket which is integrally formed so that the capability to use available space is enhanced.

Another objective of the present invention is that the memory card withdrawn direction is so adapted that the operator is able to easily accomplish the action.

Yet another objective of the present invention is that the terminals have welding points to secure the positioning of the terminals.

Still another objective of the present invention is that after the memory card is inserted into the socket, the memory card is securely sandwiched to secure the completeness and accuracy of read and write action.

Other objects, advantages and novel features of the invention will become more apparent from the following detailed description when taken in conjunction with the accompanying drawings.

DETAILED DESCRIPTION OF THE PREFERRED EMBODIMENT

Figure 1:
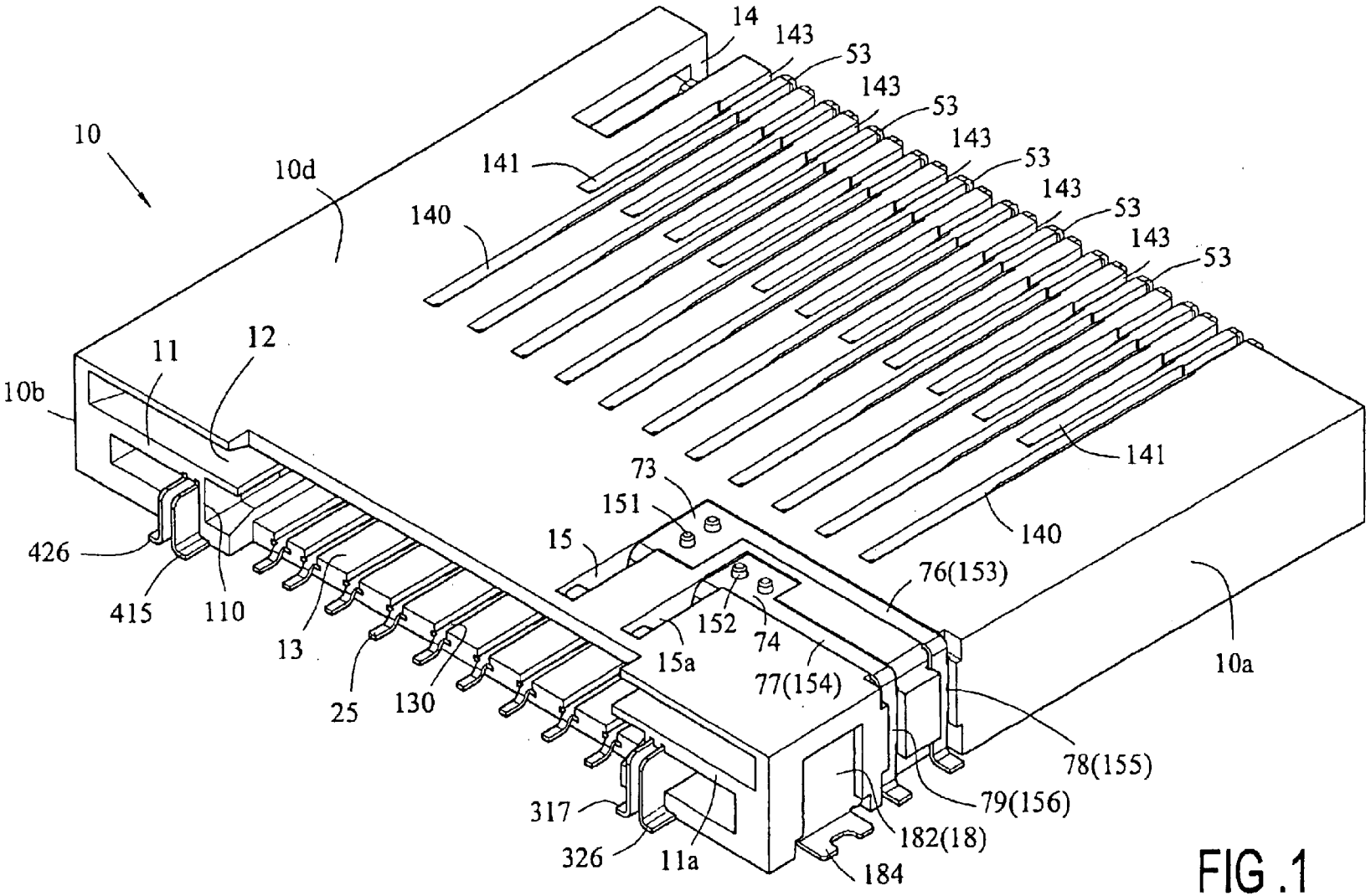
FIG. 1 is perspective view of the socket of the present invention.

With reference to FIGS. 1 to 5, the socket in accordance with the present invention includes a housing (10), a SD (secure digital) contact (20), a SD card detect contact (30), a SD write protect contact (40), a SM (smart media) contact (50), a SM card detect contact (60), a SM write protect contact (70) and a MS (memory stick) contact (80).

The housing (10) is hollow and integrally formed via injection molding so as to form as an insulator. The housing (10) has a first side (10*a*) and a second side (10*b*) opposite to the first side (10*a*). The first side (10*a*) has a first baffle (11*a*) extending from an inner face of the first side (10*a*) and the second side (10*b*) has a second baffle (11) extending from an inner face of the second side (10*b*) toward the first baffle (11*a*). The first baffle (11*a*) has a downward extending first wall (110*a*) to engage with a bottom face of the base (10). The second baffle (11) has a downward extending second wall (110) to engage with the bottom face of the base (10). Due to the downward extending first and second walls (110*a*,110) and the first baffle (11*a*) and the second baffle (11), a first slot (12) and a second slot (13) are respectively defined in the housing (10). Furthermore, a pair of first and second guiding grooves (111,112) are defined between the first baffle (11*a*) and the bottom face of the base (10) and a pair of second guiding grooves (113,114) are also defined between the second baffle (11) and the bottom face of the base (10) opposite to the first guiding grooves (111,112). The housing (10) further has a top side (10*d*) defining therein a SM terminal hole (14) and two SM protect terminal holes (15,15*a*). Multiple SM terminal fixing slots (143) are defined in the top side (10*d*) and composed of long terminal slots (140) and short terminal slots (141). Multiple MS terminal holes (16) are defined in a bottom side (10*c*) of the housing (10).

The SD contact (20) includes multiple SD contact terminals (21) each having a fixed portion (22) with at least a pair of hooks (23) formed on opposite sides of the SD contact terminal (21) to correspond to side faces defining dovetailed holes (131) which are defined in a bottom face defining the second slot (13) to communicate with the second slot (13) and have openings (130) to communicate with the dovetailed holes (131) so that after the SD contact terminals (21) are inserted into the dovetailed slots (130), the hooks (23) are able to securely engage with side faces defining the dovetailed slots (130). Each SD contact terminal (21) further has a wave-patterned contact section (24) formed on a front distal end portion of the SD contact terminal (21) and a welding portion (25) formed on a rear distal end portion opposite to the contact section (24).

The SD card detect contact (30) includes a first SD card detect terminal (31) and a second SD card detect terminal (32). The first SD card detect terminal (31) has a fixed portion (311) with a hook (310) formed on a side of the fixed portion (311) to correspond to the first guiding grooves (111) of the housing (10) such that after the first SD card detect terminal (31) is inserted into the corresponding first guiding grooves (111), the hook (310) of the fixed portion (311) is slid in the first guiding grooves (111). A cut is performed in the mediate portion of the first SD card detect terminal (31) to form a resilient contact (313). A contact (315) is formed on a front distal end portion of the first SD card detect terminal (31) and a welding portion (317) is formed on a rear distal end portion of the first SD card detect terminal (31) by bending. The second SD card detect terminal (32) has a fixed portion (322) with a hook (320) formed on a side of the fixed portion (322) to correspond to the second guiding grooves (112) to position the second SD card detect terminal (32) inside the housing (10) and maintain a distance with the first SD card detect terminal (31). A contact plate (324) is formed on a front distal end portion of the second SD card detect terminal (32) and a welding portion (326) is formed at a rear distal end portion of the second SD card detect terminal (32).

The SD write protect contact (40) is composed of a first write protect terminal (41) and a second write protect terminal (42). The first write protect terminal (41) has a fixed portion (411) with a hook (410) formed on a side of the fixed portion to correspond to a third guiding grooves (113) in the housing (10) opposite to the first guiding grooves (111) such that after the first write protect terminal (41) is inserted into the third guiding grooves (113), the hook (410) is able to engage with a side face defining the third guiding grooves (113). The first write protect terminal (41) further has a contact plate (413) formed on a front distal end portion thereof and a welding portion (415) formed on a rear distal end portion thereof. The second write protect terminal (42) has a fixed portion (422) with a hook (420) formed on a side of the fixed portion (422) to correspond to a fourth guiding grooves (114) in the housing (10) such that after the second write protect terminal (42) is inserted into the fourth guiding grooves (114), the hook (420) is able to engage with a side face defining the fourth guiding grooves (114). The second write protect terminal (42) further has a contact (424) formed on a front distal end portion thereof and a welding portion (426) formed on a rear distal end portion thereof by bending.

The SM contact (50) is composed of multiple SM long terminals (51) and multiple SM short terminals (52). Each of the SM long and short terminals (51,52) has a fixed portion (53) with a pair of opposite hooks (531) on a side of the fixed portion (53) to correspond to the SM terminal fixing slots (143) such that after the SM long terminals (51) and the SM short terminals (52) are inserted into the corresponding SM terminal fixing slots (143), the hooks (531) are able to engage with side faces defining the SM terminal fixing slots (143). Each of the SM long terminals (51) has an extension (511) extending from the fixed portion (53), a wave-line contact section (510) extending from the extension (511) and a welding portion (54) formed on a rear distal end of the fixed portion (53) by bending. The SM short terminals (52) has a wave-like contact section (520) extending directly from the fixed portion (53) and a welding portion (54') formed on a rear distal end of the fixed portion (53') by bending.

The SM card detect contact (60) has a first SM card detect terminal (61) corresponding to and to be received in the SM terminal hole (14) of the housing (10) and a second SM card detect terminal (62). The first SM card detect terminal (61) has a contact plate (610) formed on a mediate portion of the first SM card detect terminal (61) and a welding portion (611) formed on a rear distal end thereof.

The second SM card detect terminal (62) is also received in the SM terminal hole (14) of the housing (10) and on top of the first SM card detect terminal (61). The second SM card detect terminal (62) has a contact plate (620) formed on a mediate portion thereof and a welding portion (621) on a rear distal end thereof by bending.

The SM write protect contact (70) includes a SM long write protect terminal (71) and a SM short write protect terminal (72). Both the SM long write protect terminal (71) and the SM short write protect terminal (72) respectively have a fixed portion (73,74). At least one positioning hole (731,741) is defined in the fixed portion (73,74) to correspond to at least two bosses (151,152) on the top side (10*d*) of the housing (10) to enable the SM long write protect terminal (71) and the SM short write protect terminal (72) to be riveted on the top side (10*d*). A contact (75,75*a*) is formed on a distal end portion of each of the SM long write protect terminal (71) and the SM short write protect terminal (72) and able to extend into the SM protect terminal holes (15,15*a*) in the top side (10*d*) of the housing (10). A welding leg (78,79) is formed on another distal end of the SM long write protect terminal (71) and the SM short write protect terminal (72) respectively.

The MS contact (80) includes MS contact terminals (81) each having a fixed portion (82), a pair of hooks (83) oppositely formed on the fixed portion (82) to extend into openings (161) of the MS terminal holes (16) and abut side faces defining dovetailed slots (160) communicating with the openings (161). A contact (84) is formed on a front distal end portion of the MS contact terminal (81) to extend out of a corresponding one of the MS terminal holes (16). A welding portion (85) is formed on a rear distal end portion of the MS contact terminal (81). With such a structural arrangement, the socket of the present invention is accomplished and presented in FIG. 1.

Figure 2:
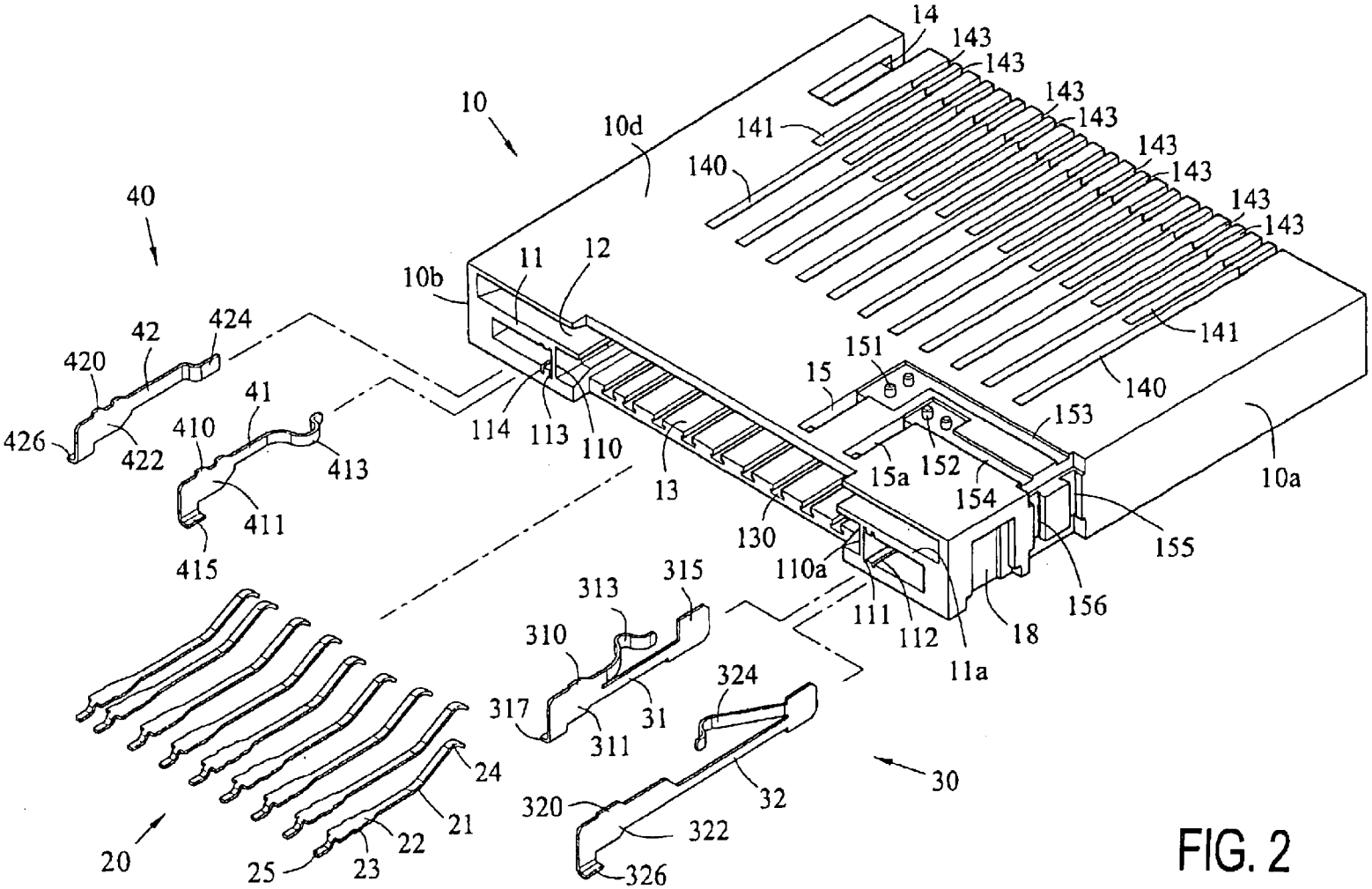
FIG. 2 is a partial exploded perspective view of the socket of the present invention.

It is to be noted that the first SD card detect terminal (31), the second SD card detect terminal (32), the first SD write protect terminal (41) and the second SD write protect terminal (42) in FIG. 2 may be provided with a pair of hooks (310,320,410,420) to secure the engagement with the side faces defining the first and second guiding grooves (111, 112,113,114).

Figure 3:
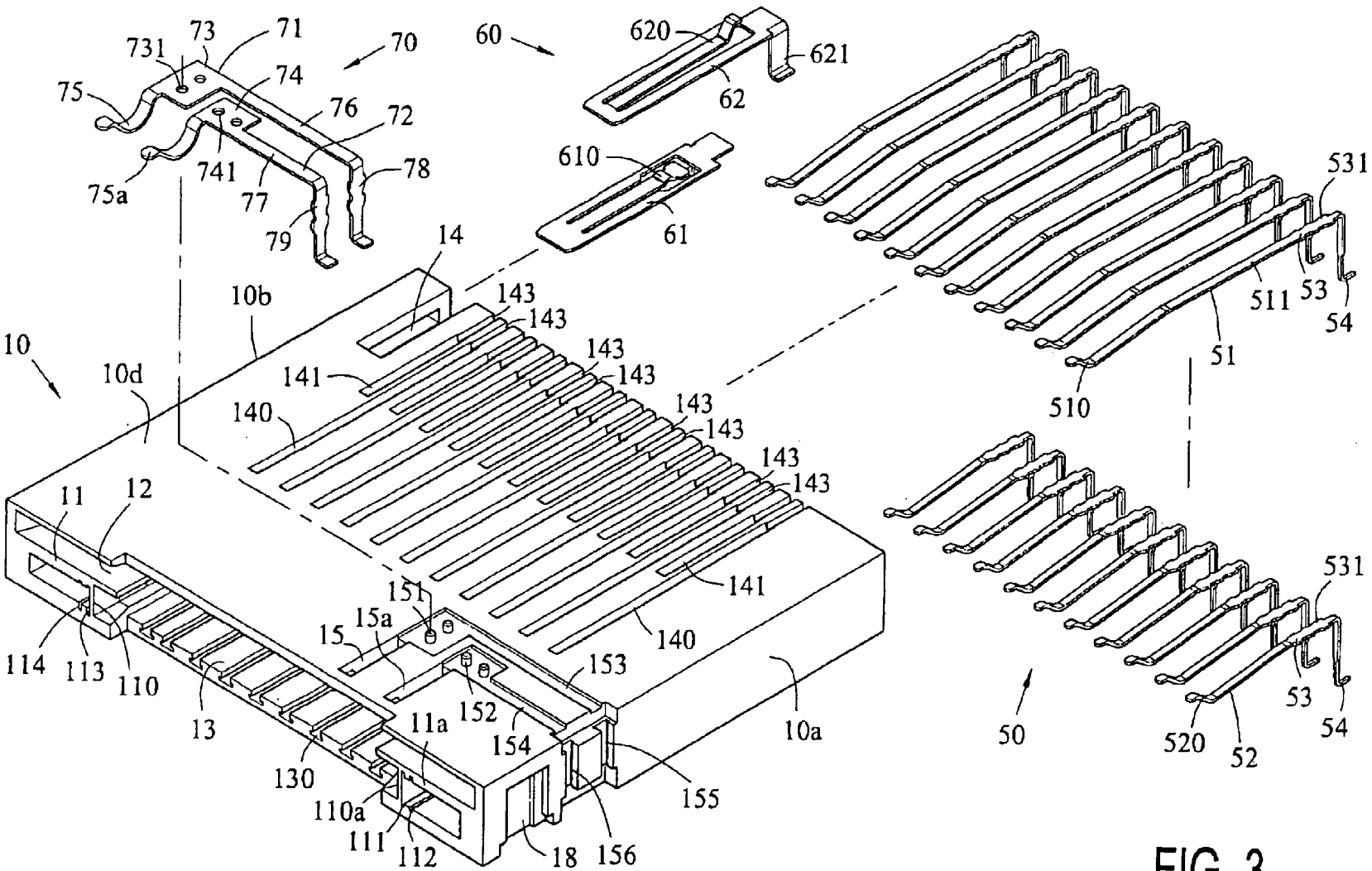
FIG. 3 is a partial exploded perspective view of the socket of the present invention.

It is necessary to address further that as shown in FIG. 3, the positioning holes (731,741) of the SM long write protect terminal (71) and the SM short write protect terminal (72) and the bosses 151,152) on the top side (10*d*) of the housing (10) may be provided with two positioning holes (731,741) and two bosses (15,15*a*) so that the engagement of the SM long write protect terminal (71) and the SM short write protect terminal (72) with the housing (10) is enhanced.

A pair of shallow grooves (153,154) may be defined in the top side (10*d*) of the housing (10) to correspond to and receive therein extensions (76,77) of the SM long write protect terminal (71) and the SM short write protect terminal (72) to secure engagement between the SM long write protect terminal (71) and the SM short write protect terminal (72) with the housing (10). Removal of the positioning holes (731,741) and the bosses (151,152) may result in that the engagement between the SM long write protect terminal (71) and the SM short write protect terminal (72) with the housing (10) depends entirely on the mutual relationship between the fixed portions (73,74) and the extensions (76, 77) and the housing (10). A pair of vertical grooves (155, 156) are defined to respectively correspond to the welding legs (78,79) and communicate with the shallow grooves (153,154) so that the engagement between the SM long write protect terminal (71) and the SM short write protect terminal (72) with the housing (10) is further secured.

Figure 4:
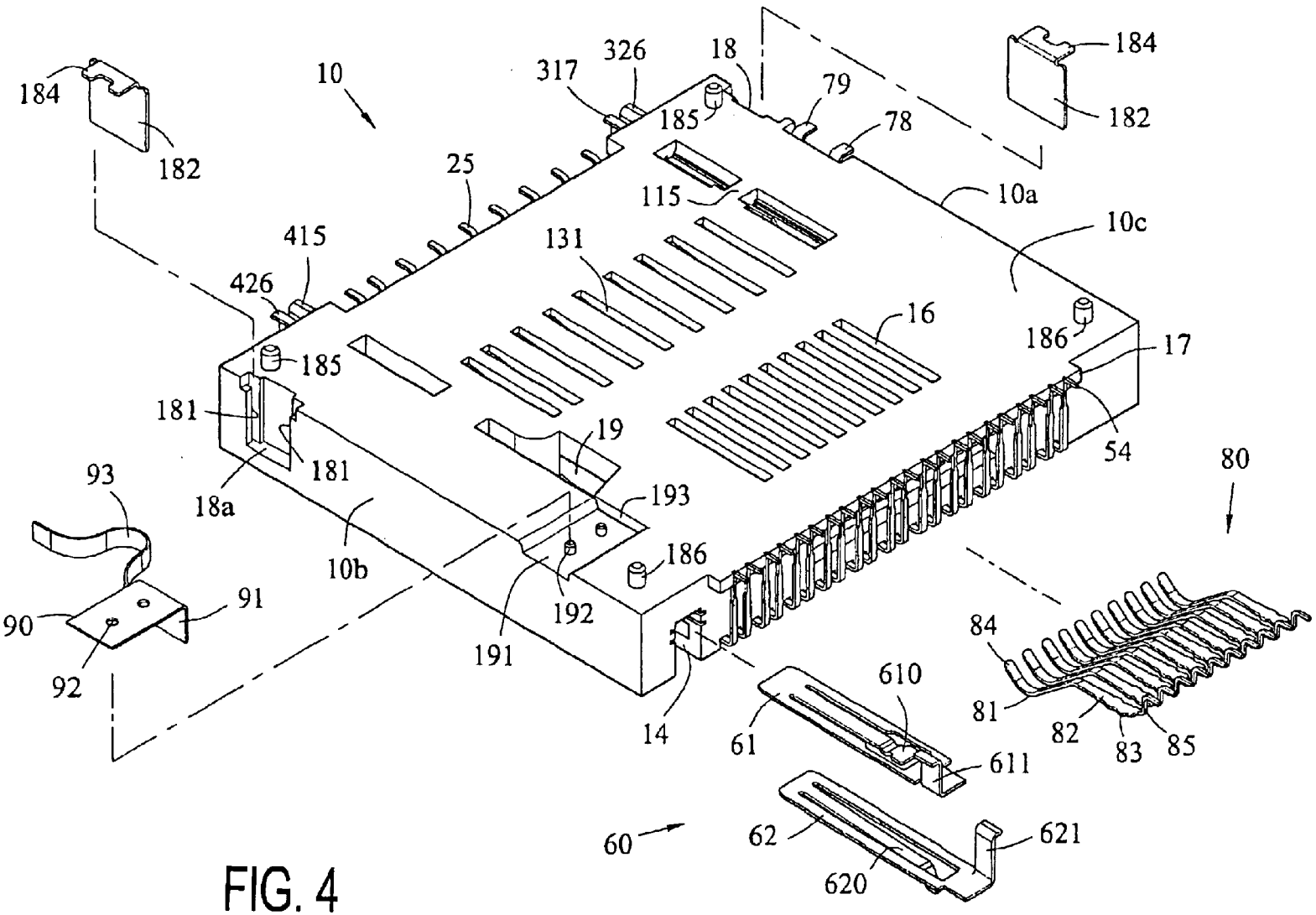
FIG. 4 is still a partial exploded perspective view of the socket of the present invention.

With reference to specifically FIG. 4, the housing (10) may further have two recessed areas (18,18*a*) each with a pair of tracks (181) defined in side walls defining the recessed areas (18,18*a*) to receive therein a fixing plate (182) which has a welding portion (184) formed on a rear distal end portion of the fixing plate (182).

The housing (10) may further have a snapping plate hole (19) and a snapping plate seat (191) provided with a boss (192) and a fixing groove (193). A MS snapping plate (90) has a fixed portion (91) to correspond to and to be received in the fixing groove (193), a positioning hole (92) defined in the fixed portion (91) to correspond to the boss (192) on the snapping plate seat (191) and a snapping contact (93) formed on a front end portion of the MS snapping plate (90). Two pairs of positioning bosses (185,186) may be formed on four corners of the bottom side (10*c*) of the housing (10) such that precision is enhanced when the housing (10) is placed on top of a PCB (printed circuit board).

Figure 5:
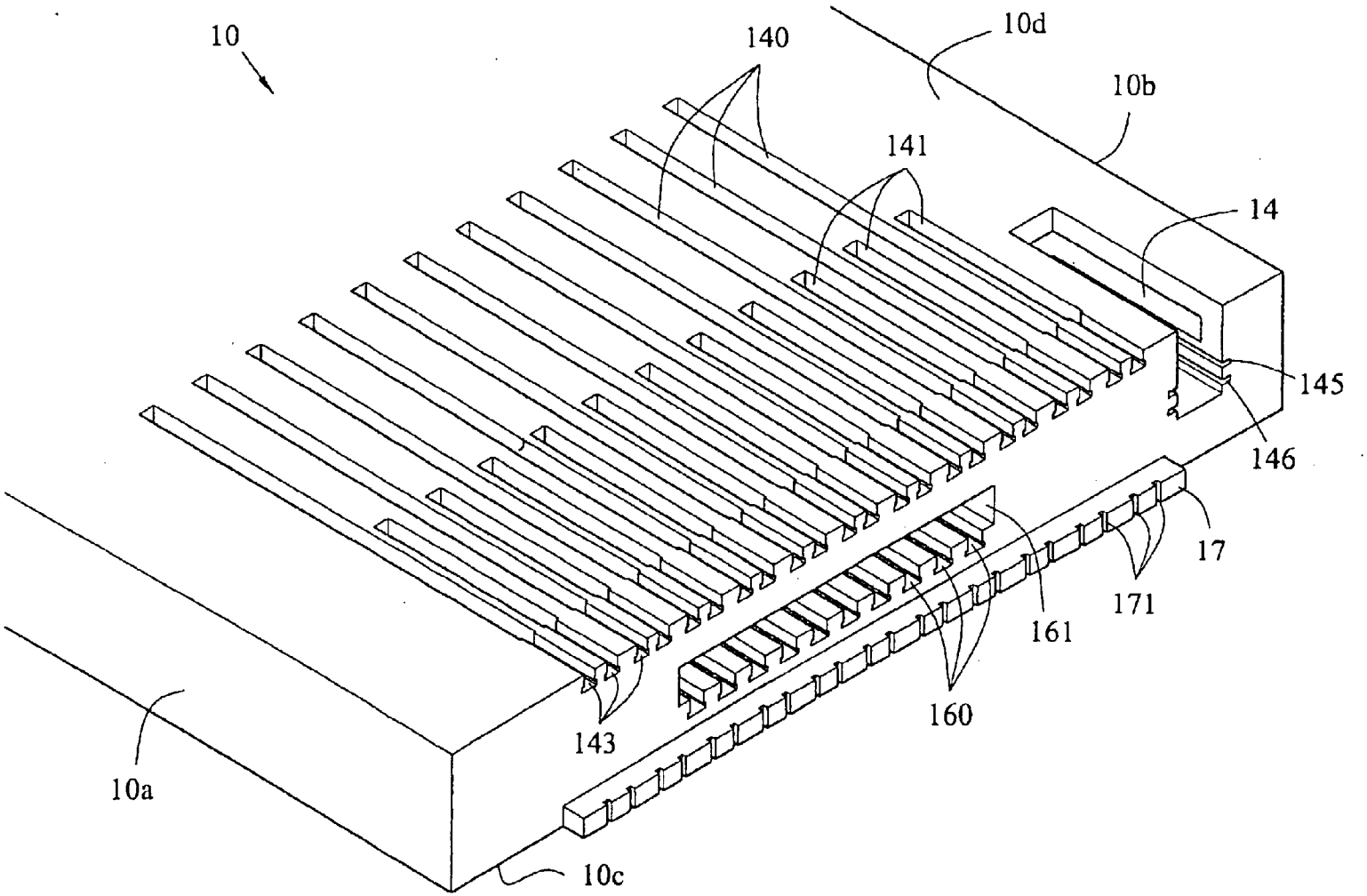
FIG. 5 is a partial perspective view showing the bottom configuration of the base of the socket of the present invention.
Figure 6:
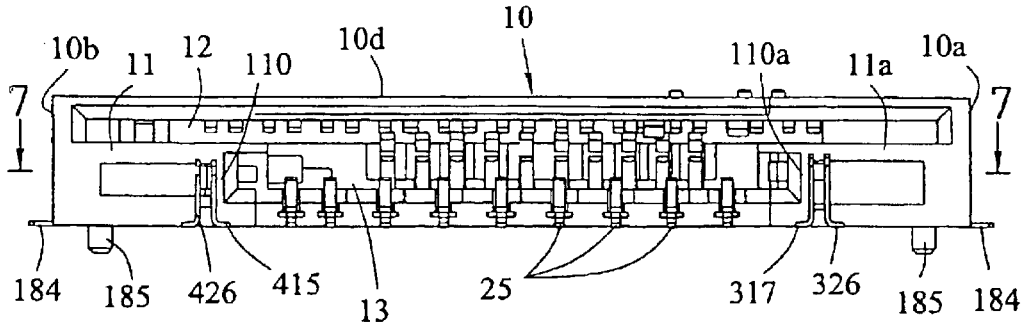
FIG. 6 is a front plan view of the socket of the present invention.
Figure 7:
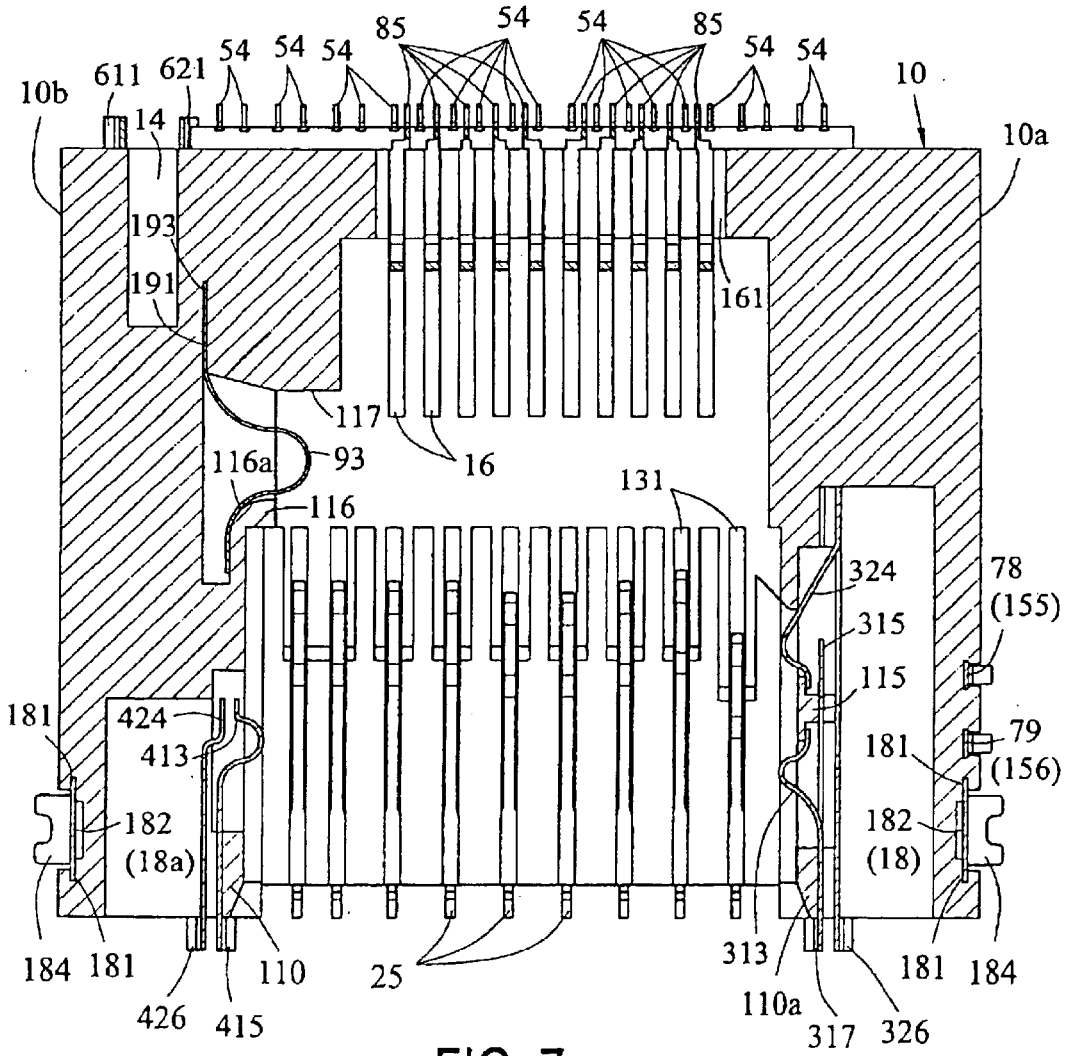
FIG. 7 is a cross sectional view of line 7—7 in FIG. 6.
Figure 8:
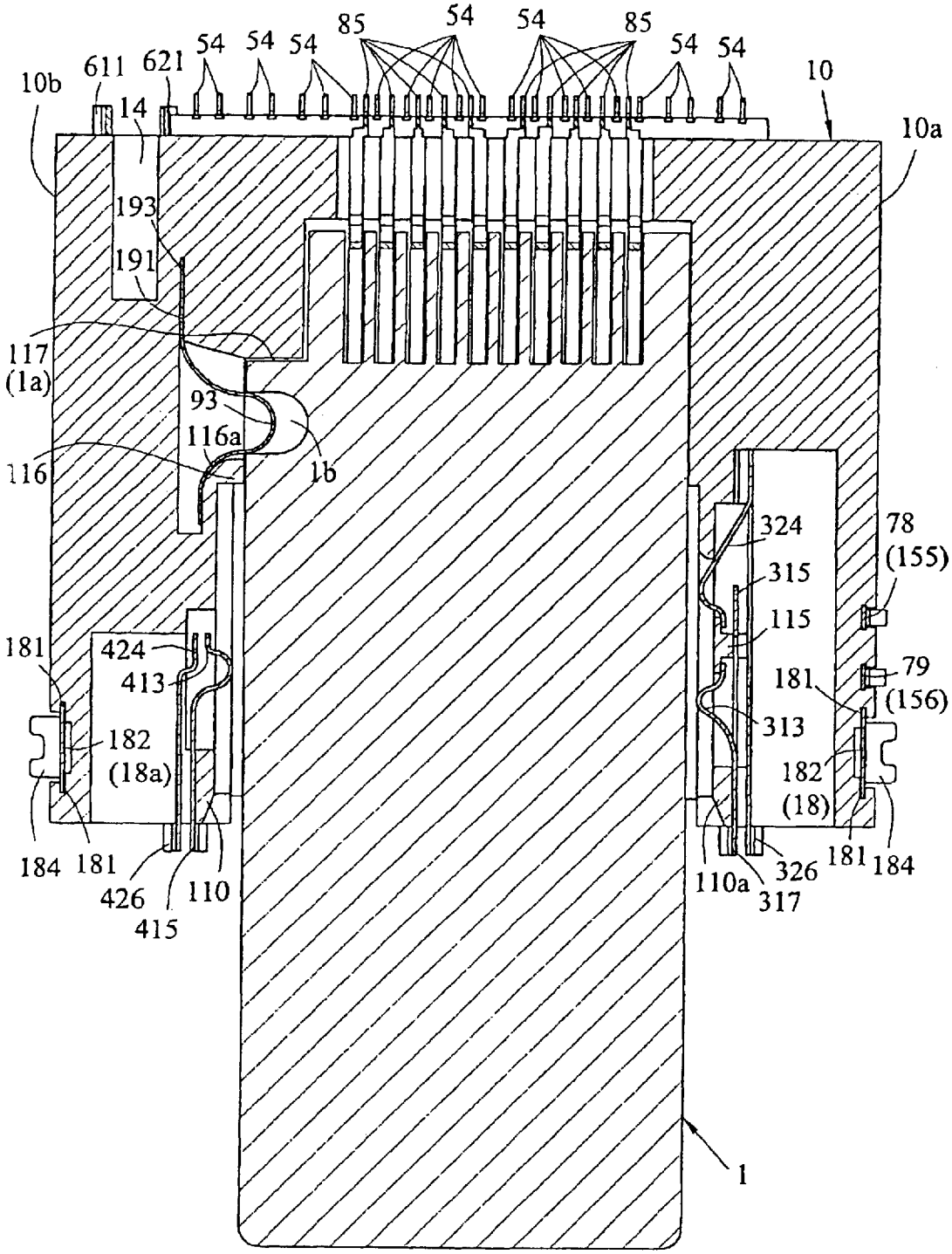
FIG. 8 is a schematic cross sectional view showing the engagement of the MS card with the socket of the present invention.
Figure 9:
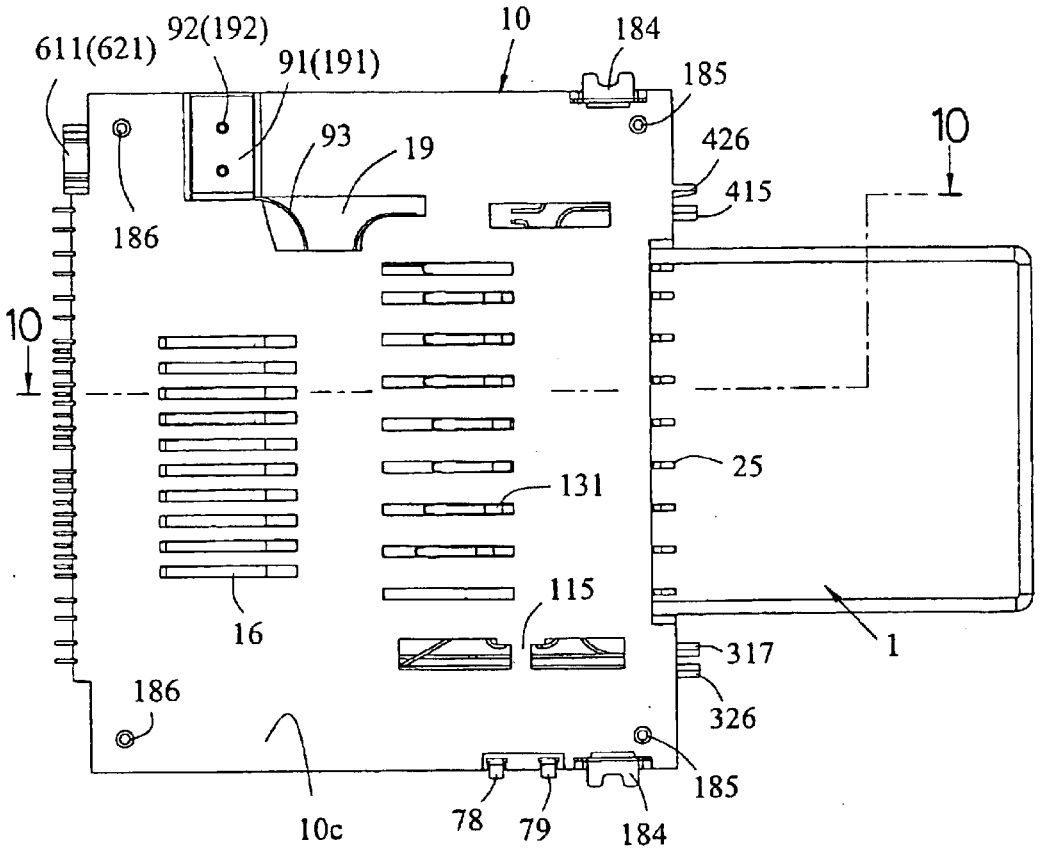
FIG. 9 is a bottom plan view of FIG. 8.
Figure 10:
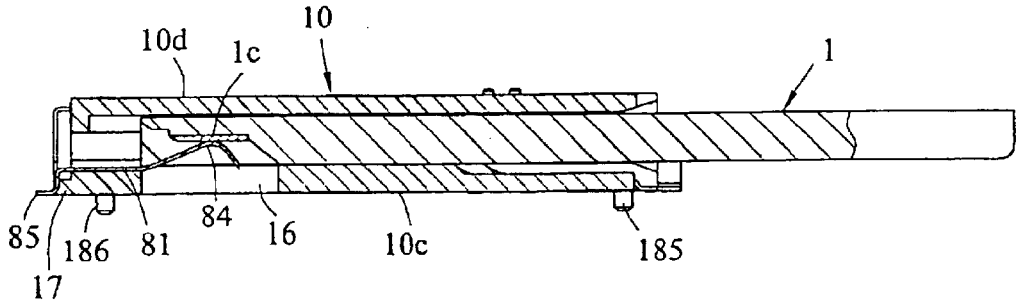
FIG. 10 is a cross sectional view of line 10—10 in FIG. 9.
Figure 11:
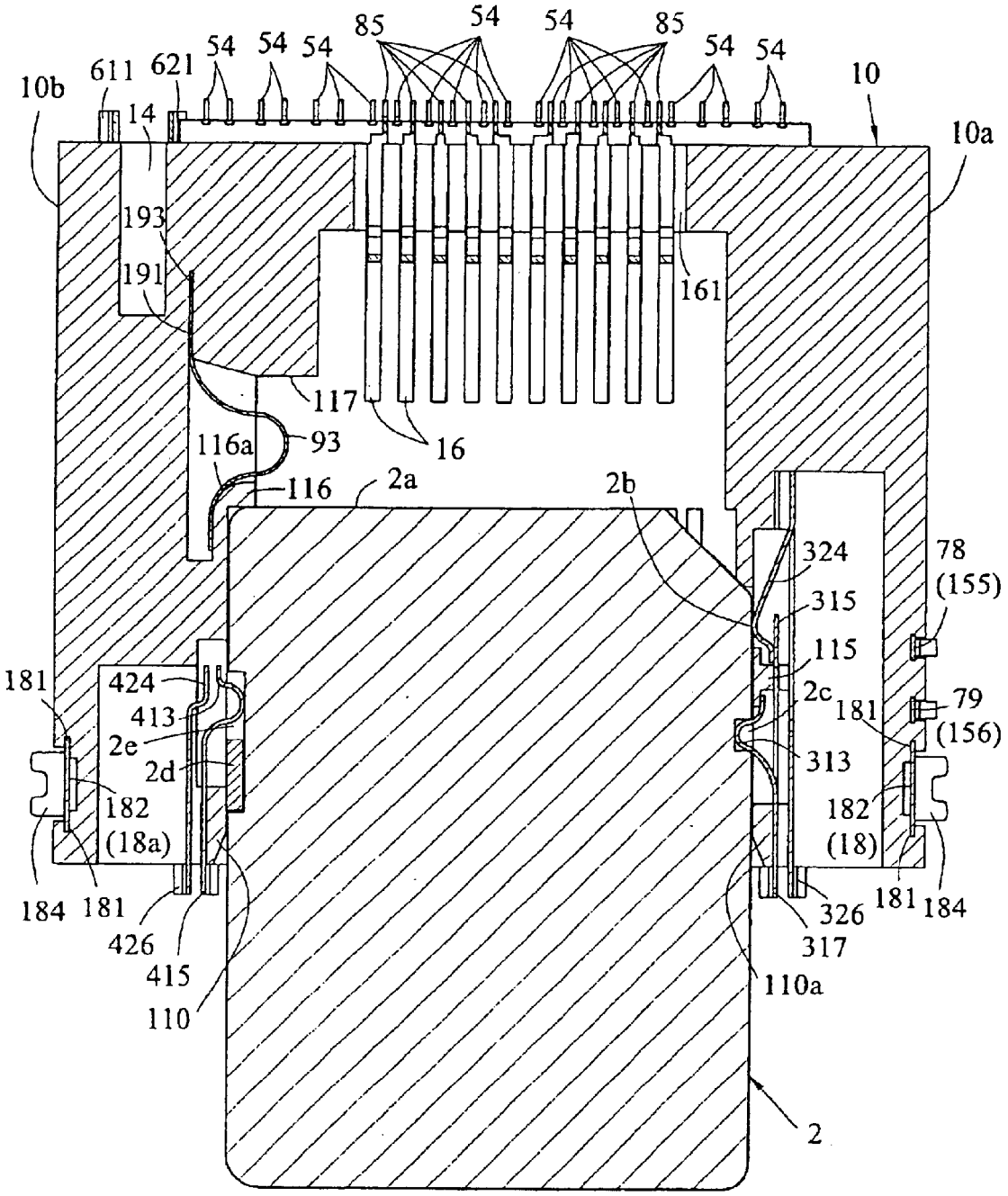
FIG. 11 is a schematic cross sectional view showing the engagement of the SD card with the socket of the present invention.
Figure 12:
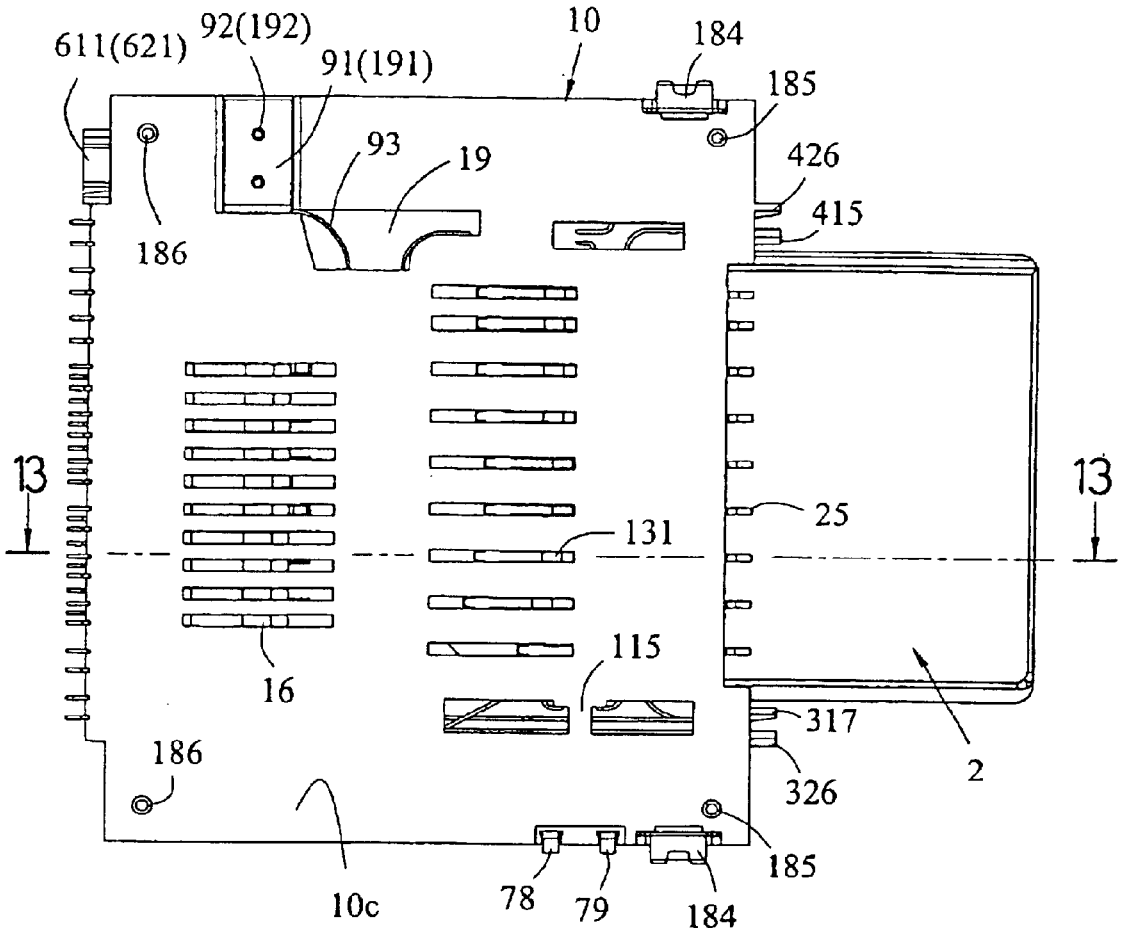
FIG. 12 is a bottom plan view of FIG. 11.
Figure 13:
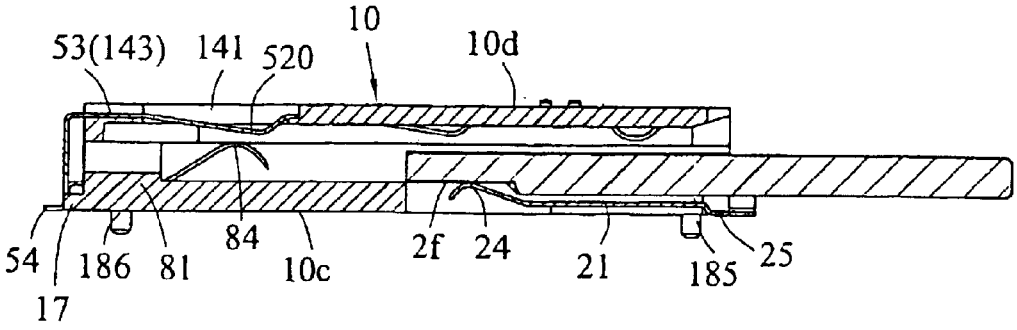
FIG. 13 is a cross sectional view of line 13—13 in FIG. 12.
Figure 14:
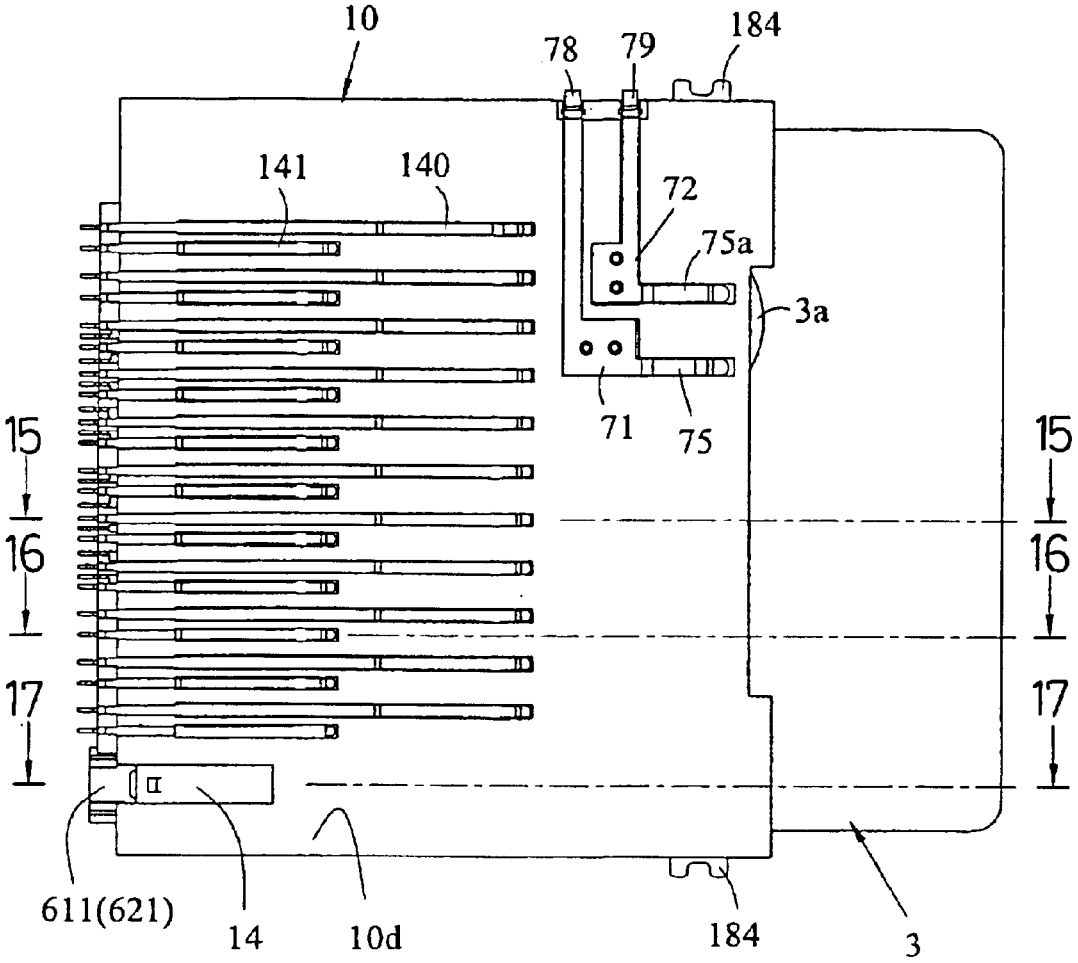
FIG. 14 is a schematic top plan view showing the engagement of the SM card with the socket of the present invention.
Figure 15:
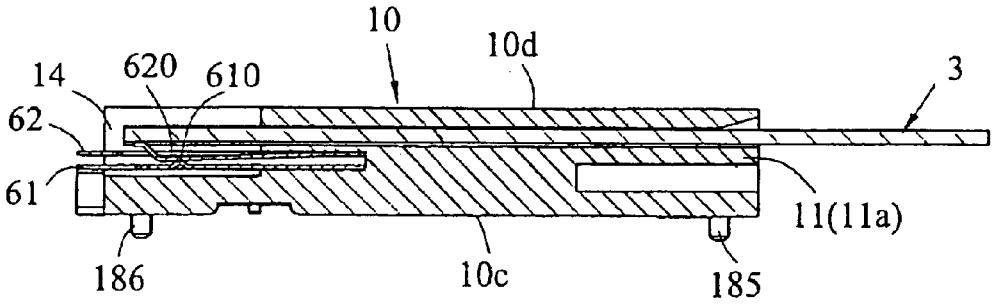
FIG. 15 is a cross sectional view of line 15—15 in FIG. 14.
Figure 16:
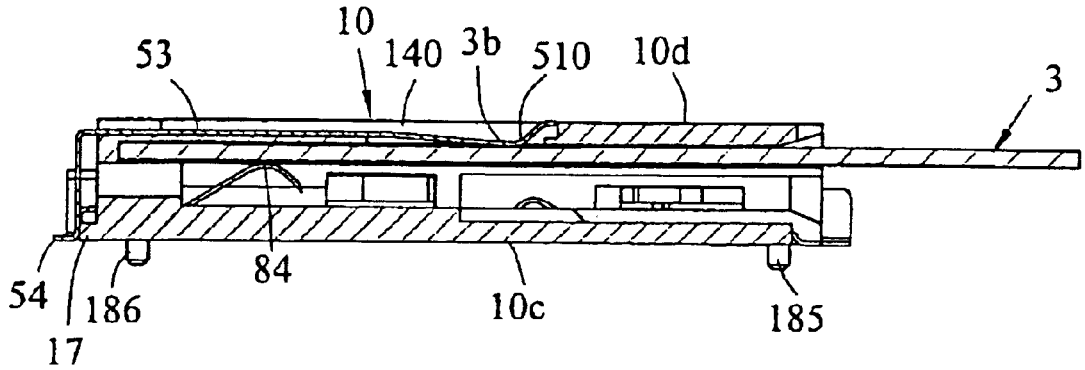
FIG. 16 is a cross sectional view of line 16—16 in FIG. 14.
Figure 17:
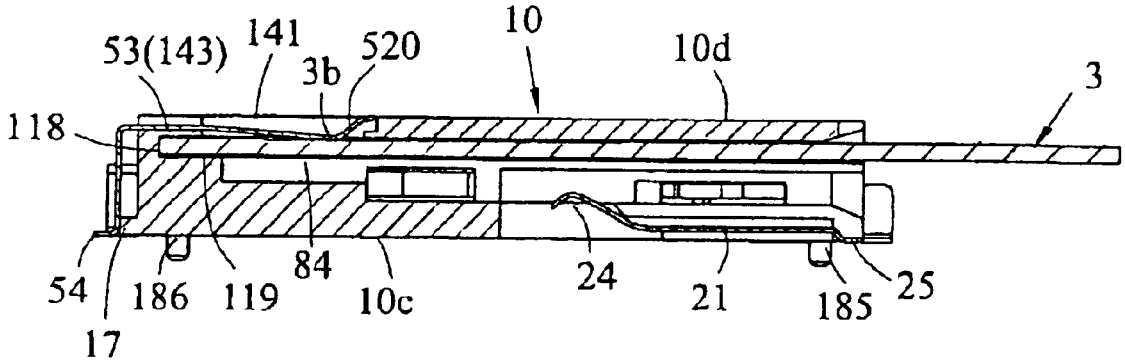
FIG. 17 is a cross sectional view of line 17—17 in FIG. 14.
Figure 18:
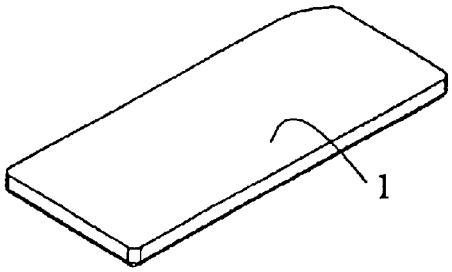
FIG. 18 a schematic perspective view of a conventional MS card.
Figure 19:
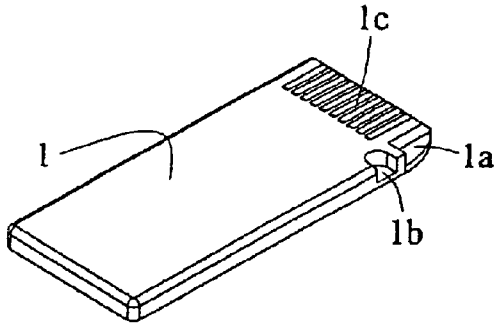
FIG. 19 is a schematic perspective view of the conventional MS card from another angle.
Figure 20:
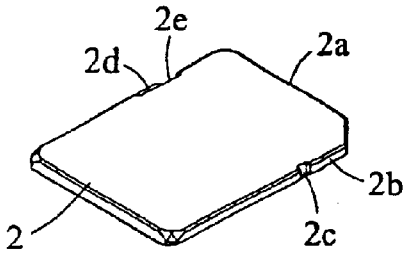
FIG. 20 is a schematic perspective view of a conventional SD card.
Figure 21:
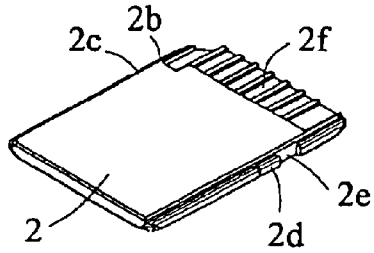
FIG. 21 is a schematic perspective view of the conventional SD card from another angle.
Figure 22:
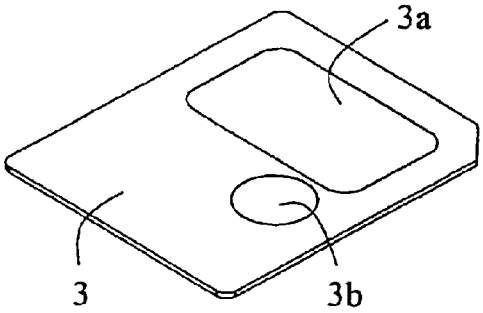
FIG. 22 is a schematic perspective view of a conventional SM card.
Figure 23:
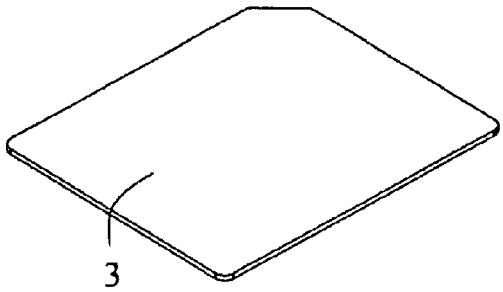
FIG. 23 is a schematic perspective view of the conventional SM card from another angle.
Figure 24:
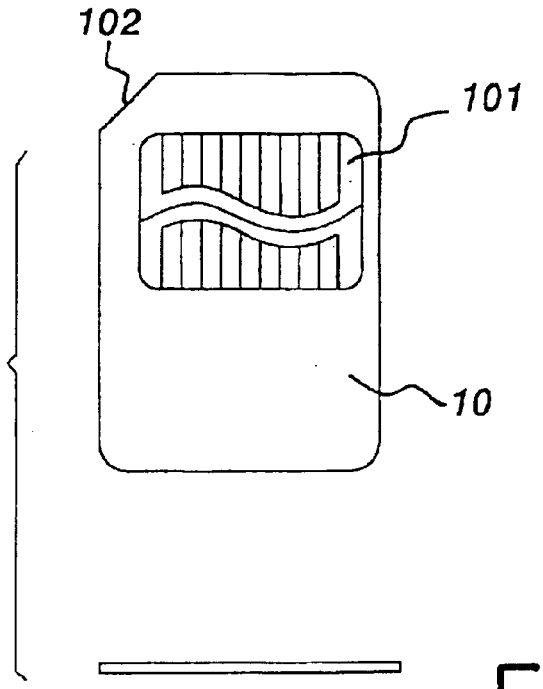
FIG. 24 PRIOR ART
FIG. 24 is a schematic top plan view of a conventional SM card.
Figure 25:
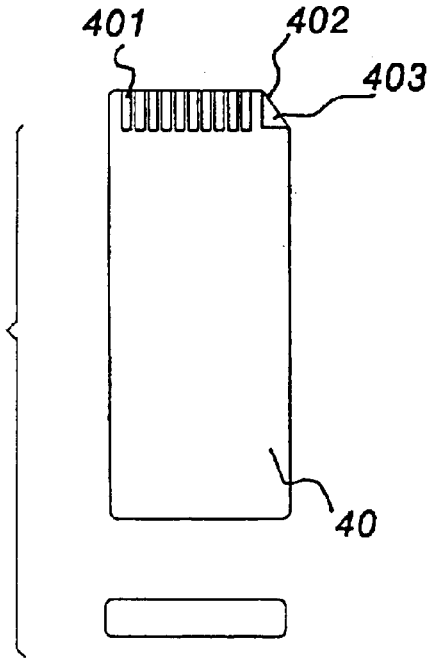
FIG. 25 PRIOR ART
FIG. 25 is a schematic top plan view of a conventional MS card.
Figure 26:
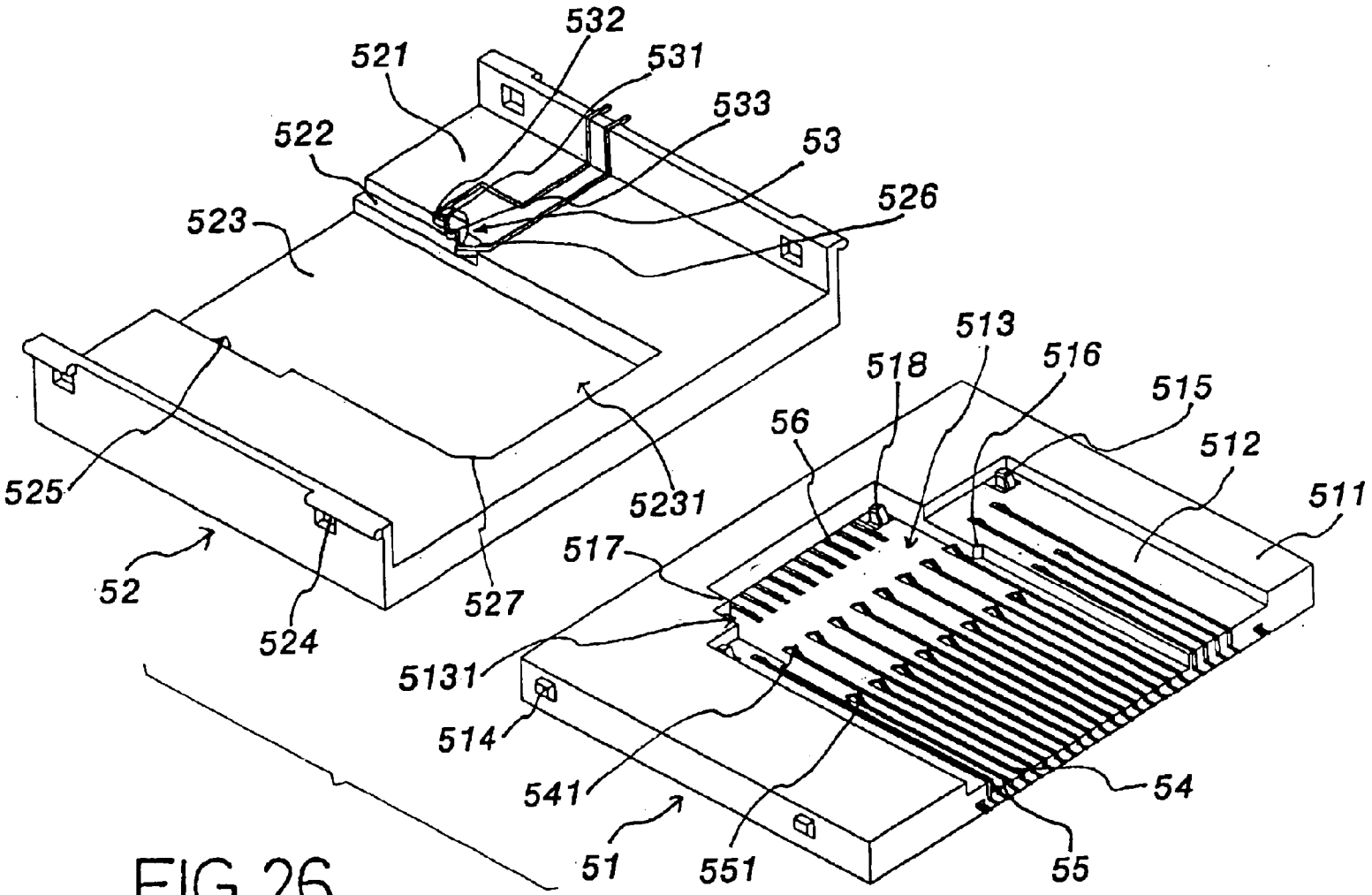
FIG. 26 PRIOR ART
FIG. 26 is an exploded perspective view of a conventional socket.

With reference to FIG. 5, a positioning block (17) is formed on a rear side of the housing (10) and has grooves (171) defined in a side face thereof to correspond to and receive therein the welding portions (54,54') of the SM long terminals (51) and SM short terminals (52) so that inclination of the housing (10) on the PCB is able to be avoided.

A pair of guiding grooves (145,146) may be provided in the SM terminal hole (14) to correspond to the SM card detect contact (60) such that engagement card between the first SM card detect terminal (61) and the second SM card detect terminal (62) and the housing (10) is enhanced.

With reference to FIGS. 6 to 10 and FIGS. 18, 19 concerning the conventional MS card (1), inside the housing (10) a T-shaped block (115) is provided to separate the resilient contact (313) and the contact (315) of the first SD card detect terminal (31) from the contact plate (324) of the second SD detect terminal (32) after the first and second SD card detect terminals (31,32) are inserted into the first and second guiding grooves (111,112).

Furthermore, a positioning block (116,117) for positioning the memory card is formed inside the housing (10). An outer contour (116*a*) of the positioning block (116) corresponds to and mates with the snapping contact (93) of the MS snapping plate (90).

When the MS card (1) is inserted into the housing (10) along the first and second walls (110,110*a*), the positioning block (117) stops a positioning cutout (1*a*) in the MS card (1) and the snapping contact (93) of the MS snapping plate (90) extends into a positioning hole (1*b*) in the MS card (1) to secure the MS card (1). The contact (84) of the MS contact terminal (81) engages with a connection plate (1*c*) on the MS card (1).

With reference to FIGS. 11 to 13 and FIGS. 20, 21 concerning the conventional SD card (2), when the SD card (2) is inserted into the second slot (13) in the housing (10) along the first and second walls (110,110*a*) and when a write protect switch (2*d*) on the SD card (2) is on (e.g. to prevent any information from inputting into the SD card (2)), the contact plate (413) of the first SD write protect terminal (41) extends into the read/write hole (2*e*) in the SD card (2) so that the contact plate (413) will not engage with the contact (424) of the second write protect terminal (42) and therefore information is prevented from entering the SD card (2). However, when the write protect switch (2*d*) is off (e.g. to allow information to enter the SD card (2)), the write protect switch (2*d*) engages with the contact plate (413) to force the contact plate (413) to engage the contact (424) of the second write protect terminal (42). Thereafter, information is able to be entered the SD card (2). Furthermore, the front end (2*a*) of the SD card (2) engages with the positioning block (116) and the right side (2*b*) of the SD card (2) engages with the contact plate (324) of the second SD card detect terminal (32) to force the contact (324) to engage with the contact (315) of the first SD card detect terminal (31). The resilient contact (313) of the first SD card detect terminal (31) is extendable into the positioning hole (2*c*) of the SD card (2). The contact section (24) of the SD contact terminal (21) engages with the connection plate (2*f*) of the SD card (2). With the foregoing structure, the conventional connection between the SD card and the housing is improved. The accuracy of information retrieval and input is ensured with the assistance of the SD card detect contact (30) and the SD write protect contact (40). Still, because the MMC card (not shown) differs from the SD card (2) in the quantity of the contact legs, the MMC card may also be applied to the socket of the present invention.

With reference to FIGS. 14 to 17 and FIGS. 22 to 23, when the SM card (3) is inserted into the first slot (12) in the housing (10), the front end (3*a*) of the SM card (3) abuts a bottom end face (118) defining the second slot (12) of the housing (10) and the SM card (3) is supported by the first and second baffles (11*a*,11) and a protrusion (119) on the bottom face defining the second slot (12). The contacts (75,75*a*) of the SM long write protect terminal (71) and the SM short write protect terminal (72) engage with the connection plate (3*b*) of the SM card (3). Simultaneously, the SM card (3) engages with the contact plate (620) of the second SM card detect terminal (62) to force the contact plate (620) to engage with the contact plate (610) of the first SM card detect terminal (61). Moreover, the contact sections (510,520) of the SM long and short terminals (51,52) connect to the connection plate (3*c*) of the SM card (3). Because the SM card (3) travels a great deal depth in the housing (10) and there are multiple SM long and short terminals (51,52), a proper clamping force to the SM card (3) is thus provided.

In summary, the socket of the present invention has the following advantages:

1. The housing (10) is integrally formed so that the socket has better ability to use available space inside the space and thus the size of the housing is compact.
2. The insertion and removal of different memory cards are integrated to adapt to the usual habit of the operator so that confusion is avoided.
3. Different contacts are inserted into the housing such that assembly is easy. Furthermore, each contact is provided with a welding portion so that inclination of the contact relative to the housing is avoided.
4. Due to the co-operation between the first and second SD card detect terminals (31,32) and the first and second SD write protect terminals (41,42), the SD card (2) is securely inserted into the housing (10) and thus a write and read action to the SD card (2) is accurate.
5. With the provision of the T-shaped block (115), the first and second SD card detect terminals (31,32) are safely separated to avoid inappropriate engagement therebetween.
6. With the provision of the snapping plate (90), the MS card (1) is securely clamped to ensure accuracy of information read and write movement.
7. The SM long write protect terminal and SM short write protect terminal (71,72) are received in the corresponding shallow grooves (153,154) in the housing (10) so as to enhance the space utilization capability of the socket of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A socket including a housing, a SD contact, a SD card detect contact, a SD write protect contact, a SM contact, a SM card detect contact, a SM write protect contact and a MS contact, wherein the housing is integrally formed as an insulator and has a first slot and a second slot by two baffles and walls upright to the baffles, dovetailed holes (131) are defined in a bottom face defining the second slot, the housing (10) further has a top side (10*d*) defining therein a SM terminal hole (14) and two SM protect terminal holes (15,15*a*), multiple SM terminal fixing slots (143) are defined in the top side (10*d*) and composed of long terminal slots (140) and short terminal slots (141), multiple MS terminal holes (16) are defined in a bottom side (10*c*) of the housing (10);

the SD contact includes multiple SD terminals each has a fixed portion (22) with a hook (23) formed on a side of the SD contact terminal (21) to correspond to a side face defining dovetailed holes (131) so that after the SD contact terminals (21) are inserted into the dovetailed slots (130), the hook (23) is able to securely engage with the side face defining the dovetailed slot (130), each SD contact terminal (21) further has a wave-patterned contact section (24) formed on a front distal end portion of the SD contact terminal (21) and a welding portion (25) formed on a rear distal end portion opposite to the contact section (24);

the SD card detect contact (30) includes a first SD card detect terminal (31) and a second SD card detect terminal (32), the first SD card detect terminal (31) has a fixed portion (311) with a hook (310) formed on a side of the fixed portion (311) to correspond to the first guiding grooves (111) of the housing (10) such that after the first SD card detect terminal (31) is inserted into the corresponding first guiding grooves (111), the hook (310) of the fixed portion (311) is slid in the first guiding grooves (111), a resilient contact is formed in the mediate portion of the first SD card detect terminal (31), a contact (315) is formed on a front distal end portion of the first SD card detect terminal (31) and a welding portion (317) is formed on a rear distal end portion of the first SD card detect terminal (31) by bending, the second SD card detect terminal (32) has a fixed portion (322) with a hook (320) formed on a side of the fixed portion (322) to correspond to the second guiding grooves (112) to position the second SD card detect terminal (32) inside the housing and maintain a distance with the first SD card detect terminal (31), a contact plate (324) is formed on a front distal end portion of the second SD card detect terminal (32) and a welding portion (326) is formed at a rear distal end portion of the second SD card detect terminal (32);

the SD write protect contact (40) is composed of a first write protect terminal (41) and a second write protect terminal (42), the first write protect terminal (41) has a fixed portion (411), a contact plate (413) formed on a front distal end portion thereof and a welding portion (415) formed on a rear distal end portion thereof, the second write protect terminal (42) has a fixed portion (422) to correspond to a fourth guiding grooves (114) in the housing (10) such that after the second write protect terminal (42) is inserted into the fourth guiding grooves (114), the fixed portion (422) is able to engage with a side face defining the fourth guiding grooves (114), the second write protect terminal (42) further has a contact (424) formed on a front distal end portion thereof and a welding portion (426) formed on a rear distal end portion thereof;

the SM contact (50) is composed of multiple SM long terminals (51) and multiple SM short terminals (52), each of the SM long and short terminals (51,52) has a fixed portion (53) to correspond to and to be received in the SM terminal fixing slots (143), each of the SM long terminals (51) has an extension (511) extending from the fixed portion (53), a wave-line contact section (510) extending from the extension (511) and a welding portion (54) formed on a rear distal end of the fixed portion (53), the SM short terminals (52) has a wave-like contact section (520) extending directly from the fixed portion (53) and a welding portion (54') formed on a rear distal end of the fixed portion (53');

the SM card detect contact (60) has a first SM card detect terminal (61) corresponding to and to be received in the SM terminal hole (14) of the housing (10) and a second SM card detect terminal (62), the first SM card detect terminal (61) has a contact plate (610) formed on a mediate portion of the first SM card detect terminal (61) and a welding portion (611) formed on a rear distal end thereof, the second SM card detect terminal (62) is received in the SM terminal hole (14) of the housing (10) and on top of the first SM card detect terminal (61), the second SM card detect terminal (62) has a contact plate (620) formed on a mediate portion thereof and a welding portion (621) on a rear distal end thereof;

the SM write protect contact (70) includes a SM long write protect terminal (71) and a SM short write protect terminal (72), both the SM long write protect terminal (71) and the SM short write protect terminal (72) respectively have a fixed portion (73,74) to enable the SM long write protect terminal (71) and the SM short write protect terminal (72) to be riveted on the top side (10*d*), a contact (75,75*a*) is formed on a distal end portion of each of the SM long write protect terminal (71) and the SM short write protect terminal (72) and able to extend into the SM protect terminal holes (15,15*a*) in a top side (10*d*) of the housing (10), a welding leg (78,79) is formed on another distal end of the SM long write protect terminal (71) and the SM short write protect terminal (72) respectively;

the MS contact (80) includes MS contact terminals (81) each having a fixed portion (82) to extend into openings (161) of the MS terminal holes (16) and abut side faces defining dovetailed slots (160) communicating with the openings (161), a contact (84) is formed on a front distal end portion of the MS contact terminal (81) to extend out of a corresponding one of the MS terminal holes (16) and a welding portion (85) is formed on a rear distal end portion of the MS contact terminal (81), whereby the socket for MS card, SD card, MMC card and SM card is formed.

2. The socket as claimed in claim 1, wherein a pair of vertical grooves (155,156) are defined in a side face of the hosing to receive therein the welding portions of the SM long and short terminals.

3. The socket as claimed in claim 1, wherein the housing has a positioning block formed on a rear side of the housing and having grooves defined in side faces thereof to correspond to and receive therein the welding portions of the SM long and short terminals.

4. The socket as claimed in claim 1, wherein the housing has a T-shaped block (115) to separate the resilient contact (313) and the contact (315) of the first SD card detect terminal (31) from the contact plate (324) of the second SD detect terminal (32) after the first and second SD card detect terminals (31,32) are inserted into the first and second guiding grooves (111,112).

5. The socket as claimed in claim 1, wherein the housing has two recessed areas (18,18*a*) to receive therein a fixing plate (182) which has a welding portion (184) formed on a rear distal end portion of the fixing plate (182).

6. The socket as claimed in claim 1, wherein the housing further has a snapping plate hole (19) and a snapping plate seat (191) provided with a fixing groove (193), a MS snapping plate (90) has a fixed portion (91) to correspond to and to be securely received in the fixing groove (193) and a snapping contact (93) formed on a front end portion of the MS snapping plate (90) to be riveted on the snapping plate seat.

7. The socket as claimed in claim 1, wherein the housing further has two pairs of positioning bosses (185,186) may be formed on four corners of the bottom side (10*c*) of the housing (10) such that precision is enhanced when the housing (10) is placed on top of a printed circuit board.

* * * * *